US005331388A

United States Patent [19]

Marotta et al.

[11] Patent Number: 5,331,388

[45] Date of Patent: Jul. 19, 1994

[54] SIMPLE RELIABLE COUNTER ASSEMBLY OF REDUCED PARTS FOR A TONER CARTRIDGE

[75] Inventors: Joseph J. Marotta, Webster; Bruce C. Reynolds, Rochester, both of N.Y.

[73] Assignee: Xerox Corporation, Stamford, Conn.

[21] Appl. No.: 997,010

[22] Filed: Dec. 28, 1992

[51] Int. Cl.[5] ..... G03G 15/00; G03G 21/00

[52] U.S. Cl. ..... 355/260; 235/91 M; 235/103; 355/200

[58] Field of Search ..... 355/200, 210, 260; 235/91 M, 98 C, 103; 340/615

[56] References Cited

U.S. PATENT DOCUMENTS

| | | | |
|---|---|---|---|
| 62,398 | 2/1867 | Couse | 235/103 |
| 3,334,811 | 8/1967 | Sigl | 235/103 |
| 3,985,436 | 10/1976 | Tanaka et al. | 355/200 |
| 4,218,126 | 8/1980 | Takeichi | 355/298 |
| 4,556,308 | 12/1985 | Hoppner et al. | 355/200 |
| 4,803,513 | 2/1989 | Nishise et al. | 355/260 X |
| 4,877,341 | 10/1989 | Cherbuy et al. | 355/215 X |
| 4,913,448 | 4/1990 | Bhagwat et al. | 355/260 X |
| 5,084,734 | 1/1992 | Yoshino et al. | 355/260 |
| 5,111,246 | 5/1992 | Brailsford et al. | 355/245 |
| 5,184,181 | 2/1993 | Kurando et al. | 355/260 |
| 5,189,475 | 2/1993 | Fournia et al. | 355/260 X |

*Primary Examiner*—Fred L. Braun

[57] ABSTRACT

A counter assembly which can be used in a toner cartridge has a generally circular rotatable actuator member fixedly mounted on one end of a shaft having a screw thread on its surface, a magnet made of a molded compliant magnetic material mounted on the screw thread surface of the shaft adjacent to the actuator member. The magnet is secured against rotational movement but is permitted longitudinal movement along the screw thread surface of the shaft. The actuator member is rotated in a direction to transport the magnet along the screw thread surface of the shaft away from the actuator.

18 Claims, 3 Drawing Sheets

SIMPLE RELIABLE COUNTER ASSEMBLY OF REDUCED PARTS FOR A TONER CARTRIDGE

BACKGROUND OF THE INVENTION

The present invention is directed to a simplified low cost counter assembly. In a specific application it has use in electrostatographic printing apparatus and in particular, it provides an indication that a removable toner cartridge is about to or has exhausted its useful life.

Recently, there has been a tendency in the design of electrostatographic printing apparatus to place one or more of the functional units such as a photoconductor drum or developer housing in a removable processing cartridge or unit so that the customer or operator of the printing machine may replace a functional unit when its lifetime has been exhausted or a different processing parameter such as toner color is desired. Exemplary of such machines are those described and illustrated, for example, in U.S. Pat. Nos. 3,985,436 to Tanaka et al., 4,556,308 to Hoppner et al. and 5,111,246 to Brailsford et al., all of which are hereby incorporated in their entirety herein by reference. Accordingly, the removable processing cartridges may be designed to contain a photoreceptor, a developing device, a cleaning device, as well as a charging device. Alternatively, instead of placing all of the functional elements in a single processing cartridge, there may be two or more processing cartridges wherein, for example, the photoreceptor, cleaning device and charge device are in one removable processing cartridge while the developer device is in another removable processing cartridge.

There is a desire for the operator to know when the end of the functional lifetime of a removable processing unit is approaching and when it has finally approached. This is true whether the functional unit comprises a photoreceptor, a developer housing, or indeed is a toner cartridge. It is particularly important to the operator to have some warning that the supply of toner or developer to the developer housing from a toner cartridge is about to be exhausted or in fact is exhausted.

PRIOR ART

U.S. Pat. No. 4,551,000 to Kanemitsu et al. describes a removable process which includes an indicator for indicating when the useful life of the process unit is about to expire and/or when it has expired.

Other types of counters or indicators have also been proposed. Typically, they involve a series of ratcheting gear mechanisms which involve a large number of parts and are very difficult to assemble, typically requiring manual assembly. Both the large number of parts and the requirement that they be manually assembled lead to substantial cost for these counters which is of some significance since they typically are used in the smaller lower cost electrostatographic printing machines. In addition, with a large number of moving parts, in particular the gears, over time tend to wear out leading to improper functioning of the counter and incorrect warning to the operator.

SUMMARY OF THE INVENTION

It is therefore an object of this invention to provide a simple highly reliable counter assembly with substantially reduced parts and at a substantially reduced cost.

In a principal aspect of the present invention, the counter comprises a generally circular rotatable actuator member fixedly mounted on one end of a shaft having a screw thread on its surface, a magnet made of a molded compliant magnetic material mounted on the screw thread surface of the shaft adjacent to the actuator member, means to secure the magnet against rotational movement and permit longitudinal movement along the screw thread surface of the shaft and means to rotate the actuator member in a direction to transport the magnet along the screw thread surface of the shaft away from the actuator member.

In a further aspect of the present invention, the pitch of the screw thread and the direction of rotation of the shaft are selected so that on rotation of the shaft, the screw thread surface on said shaft creates a second screw thread in the magnet which tends to drive the magnet away from the actuator.

In a further aspect of the present invention, the rotatable actuator member is a friction roll or a gear and the means to rotate is a rotatable pawl.

In a further aspect of the present invention, the rotatable pawl is fixedly mounted on the end of a driven shaft such as that of the toner agitator in a toner cartridge.

In a further aspect of the present invention, the means to secure the magnet against rotational movement comprises a curve shaped housing in securing engagement with an extended substantially flat surface on the magnet.

In a further aspect of the present invention, the rotatable pawl is rotated by a drive system including at least one gear.

In a further aspect of the present invention, the friction roll is deformable and the pawl is rigid and vice-versa.

DETAILED DESCRIPTION OF PREFERRED EMBODIMENT

Figure 1:
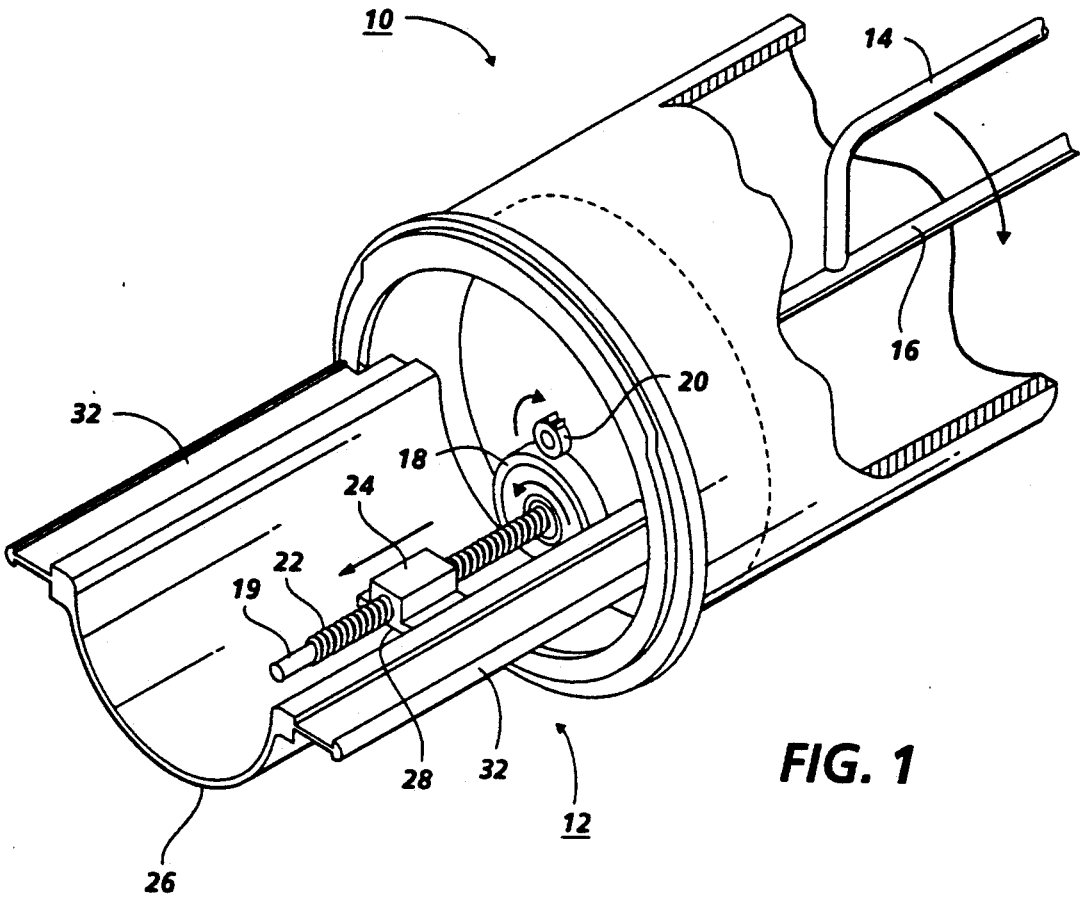
FIG. 1 is an isometric view of a simplified counter assembly according to the present invention.

Turning now to FIG. 1 there is illustrated a toner cartridge 10 having a simplified counter assembly 12 according to the present invention on one end thereof. The toner cartridge is filled with toner material and is designed to be inserted into a developer housing in an electrostatographic printing machine. The toner cartridge contains an agitator 14 for mixing and dispensing toner to the developer housing from the toner cartridge. The agitator 14 is mounted on a shaft 16 which is rotated by the drive system (not shown) for the developer housing. The cartridge assembly comprises a generally circular rotatable actuator member 18 which is fixedly mounted on one end of a shaft 19 having a screw thread surface 22. The actuator member is here illustrated as a friction roll which is rotated in the indicated direction by the rotatable pawl 20 which is fixedly mounted on the end of the agitator shaft 16 in the toner cartridge.

Figure 4:
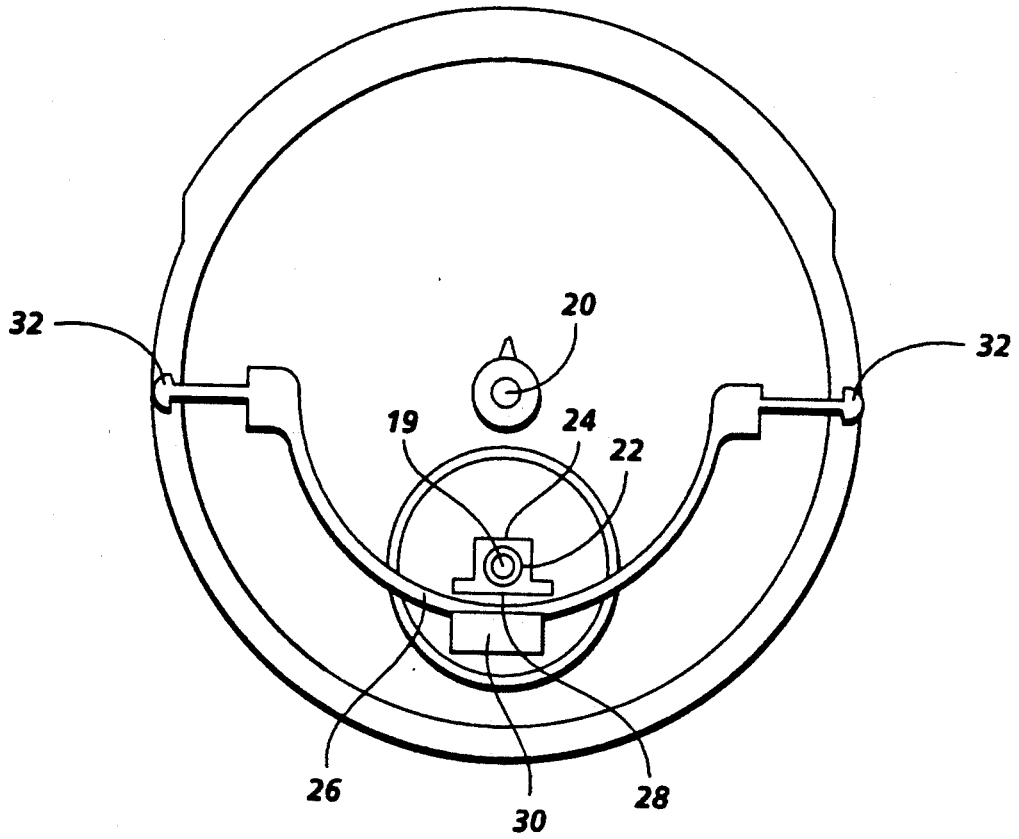
FIG. 4 is an end view of a simplified counter assembly according to the present invention illustrating the curve shaped housing and the extended flat surface on the magnet which secures the magnet against rotational movement.

While the friction roll maybe relatively hard or soft and the pawl may also be relatively hard or soft it is preferred that one of them be soft and one of them be hard. Typically, therefore the friction roll is made of a soft rubber or elastomeric material having a high coefficient of friction such as a polyurethane or silicone elastomer and the pawl is rigid being made of steel or plastic. Accordingly, the friction roll is rotated by virtue of the probe on the pawl deforming the surface of the friction roll. This provides intermittent drive of the friction roll from the continuous drive of the pawl since it comes into contact with the friction roll only once in every 360° circle for only a small arc. A magnet 24 made from a molded compliant magnetic material such as a ferrite and in particular a composition comprising 90% by weight barium hexaferrite with 5% polyisobutylene and 5% by weight chlorosulfonated polyethylene is mounted on the screw thread surface 22 of the shaft 19 adjacent the actuator member 18 at the beginning of its counting cycle. The magnet 24 is inserted or mounted on the screw thread surface 22 by merely pushing it from the open end onto the screw thread. When the friction roll 18 is rotated, the screw thread surface 22 on the shaft is also rotated and the magnet 24 is transported along the screw thread surface 22 away from the friction roll 18. The magnet is secured against rotational movement while being permitted to longitudinally move along the screw thread surface by a curved shape housing 26 (see FIG. 4) which is in contact and nonrotational engagement with an extended substantially flat surface 28 on the magnet. Since the magnet can't turn as the screw rotates a corresponding screw thread is created in the molded compliant interior of the magnet which enables it to be longitudinally transported along the screw thread surface away from the friction roll. To enable this, the pitch of the screw thread and the direction of rotation of the shaft are selected so that on rotation of the shaft the screw thread surface creates a second screw thread in the magnet which tends to drive the magnet away from the friction roll. For example, a clockwise rotation of the shaft and a left hand screw thread will drive the magnet in the direction indicated in FIGS. 1 and 2.

In operation as the toner cartridge agitator 14 rotates in the indicated direction it also rotates the pawl 20 in the same direction which contacts the friction roll 18 once in every 360° driving it in the opposite direction. The magnet 24 on the screw thread surface 22 of the shaft 19 which is fixed to the friction roll has a screw thread created therein in response to the screw thread surface on the shaft by virtue of the fact that it can not rotate about the shaft. Accordingly, the magnet tends to walk or screw itself along the screw thread on the shaft away from the friction roll. A magnetic sensor 30 (See FIG. 4) is positioned underneath the counter housing such that when the magnet is detected a signal may be sent to the main control panel indicating a particular state or condition with regard to the supply of toner in the toner cartridge. It may for example, give a warning that the toner cartridge has reached a certain identified depleted state and that a new supply of toner should be ordered or it may provide the signal to the main control panel to stop the electrostatographic machine. Indeed, it may provide more than one indicator of the remaining supply of toner in the toner cartridge by crossing the path of more than one sensor as it is screwed along the screw thread on the shaft. The toner cartridge is also provided with a handle 32 at the end of the housing which is used to facilitate insertion and removal of the toner cartridge in the developer housing by the operator. Toner consumption can be directly correlated to the number of revolutions of the toner agitator. In this way the number of revolutions of the toner agitator may be directly correlated to the number of revolutions of the friction roll and thereby the distance that the magnetic is moved along the screw thread on the shaft to the magnetic sensor.

In an alternative embodiment the counter assembly could be mounted on the drive shaft of a segmented feed roll used to separate and feed sheets in an electrostatographic printing machine which makes one complete revolution per sheet fed and thereby provide an accurate count of the number of sheets fed or prints made.

Figure 2:
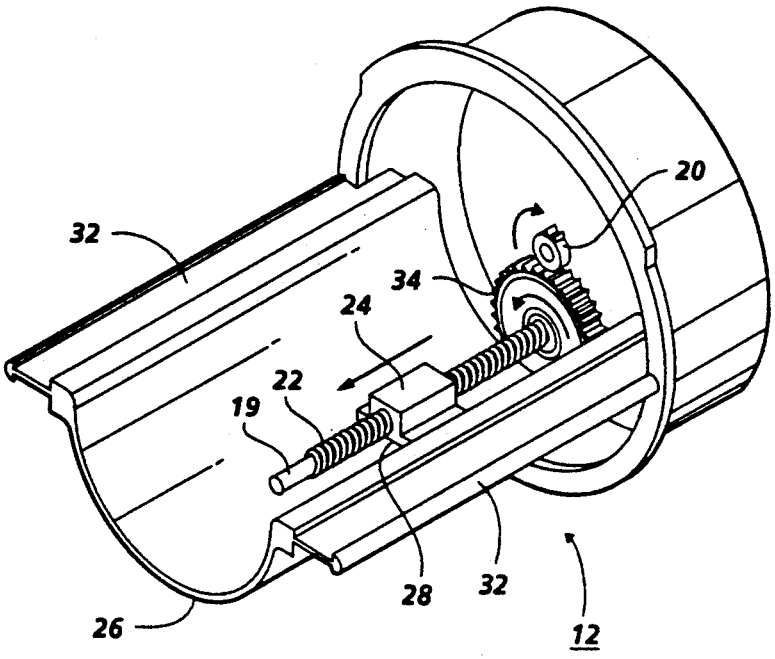
FIG. 2 is an alternative embodiment of a simplified counter assembly according to the present invention.
Figure 3:
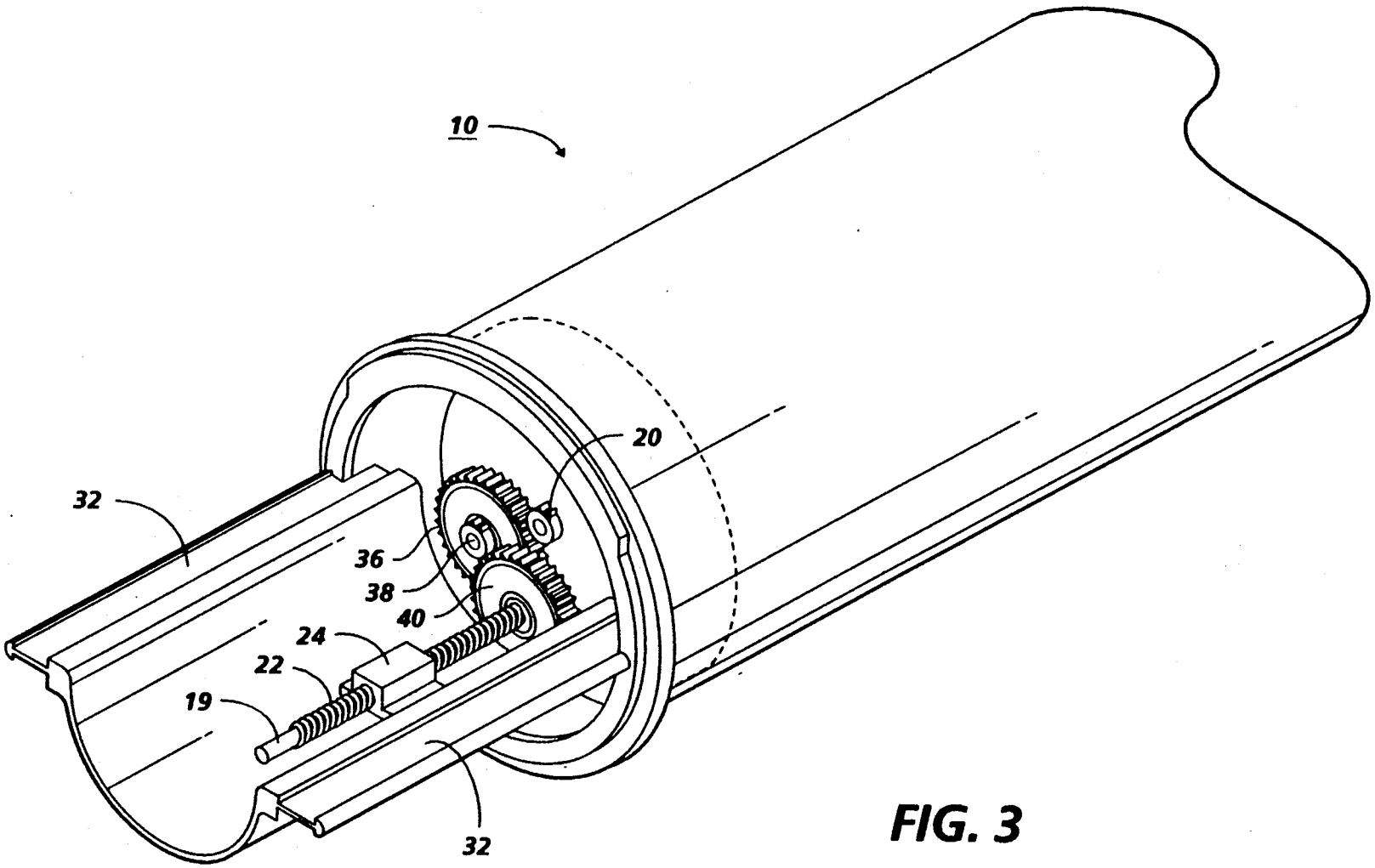
FIG. 3 is a further alternative embodiment of a simplified counter assembly according to the present invention.

Turning now to FIGS. 2 and 3 two alternative embodiments of the counter assembly according to the present invention will be described. In FIG. 2 the friction roll has been replaced by a toothed gear 34, the remaining structure and operation being the same as that illustrated in FIG. 1. FIG. 3 is a further alternative embodiment wherein the pawl 20 on the end of the agitator shaft is used to drive a gear 36 which has securely mounted on it a second pawl 38 to drive a gear 40 on the end of the shaft 19 with a screw thread 22. In this way, additional gear reductions are enabled. In addition, the selection of the thread pitch, the number of teeth on the gear and the pitch of the gear control the speed with which the magnet moves down the shaft.

Thus, according to the present invention a simplified counter assembly has been provided which is highly reliable, simple, substantially reduced parts and is easier and less costly to assemble.

All the patents referred to herein are hereby specifically and totally incorporated herein by reference.

While the invention has been described with reference to specific embodiments it will be apparent to those skilled in the art that many alternatives, modifications and variations may be made. For example, while the invention has been described and illustrated with reference to the counter assembly being used on the end of a toner cartridge it will be appreciated that it has many other applications. For example, it has been mentioned that it may be used to count prints made in an electrostatographic printing machine by being assembled to the shaft of a segmented feed roll in a paper feeder in a printer. Alternatively it may also be assembled on the end of a rotatable photoreceptor drum. Accordingly, it is intended to embrace all such alternatives modifications as may fall within the spirit and scope of the appended claims.

We claim:

1. A counter assembly comprising a generally circular rotatable actuator member fixedly mounted on one end of a shaft having a screw thread on its surface, a magnet made of a molded compliant magnetic material mounted on said screw thread surface of said shaft adjacent to said actuator member, means to secure said magnet against rotational movement and permit longitudinal movement along the screw thread surface of said shaft, means to rotate said actuator member in a direction to transport said magnet along said screw thread surface of said shaft away from said actuator and wherein the pitch of the screw thread and the direction of rotation of said shaft are selected so that on rotation of said shaft the screw thread surface on said shaft creates a second screw thread in said magnet which tends to drive said magnet away from said actuator.

2. The counter of claim 1 wherein said magnet is a ferrite.

3. The counter of claim 1 wherein said rotatable actuator member is a friction roll and said means to rotate is a rotatable pawl.

4. The counter of claim 3 wherein said friction roll is deformable and said pawl is rigid.

5. The counter of claim 3 wherein said friction roll is rigid and said pawl is deformable.

6. The counter of claim 1 wherein said means to rotate is a rotatable pawl fixedly mounted on the end of a drive shaft.

7. The counter of claim 6 wherein said drive shaft is an agitator in a toner cartridge.

8. The counter of claim 1 wherein said means to secure said magnet against rotational movement comprises a curved shaped housing in securing engagement with said magnet.

9. The counter of claim 8 wherein said magnet has an extended substantially flat surface in securing nonrotational engagement with said curved shaped housing.

10. The counter of claim 1 wherein said rotatable actuator member is a gear and said means to rotate is a rotatable pawl.

11. The counter of claim 10 wherein said rotatable pawl is rotated by a drive system including at least one gear.

12. A toner cartridge comprising a generally circular elongated tube, a rotatable toner agitator extending the length of said tube, a toner dispensing opening in said tube and a counter assembly mounted on one end of said tube said counter assembly comprising a generally circular rotatable actuator member fixedly mounted on one end of a shaft having a screw thread on its surface, a magnet made of a molded compliant magnetic material mounted on said screw thread surface of said shaft adjacent to said actuator member, means to secure said magnet against rotational movement and permit longitudinal movement along the screw thread surface of said shaft, means to rotate said actuator member in a direction to transport said magnet along said screw thread surface of said shaft away from said actuator and wherein the pitch of the screw thread and the direction of rotation of said shaft are selected so that on rotation of said shaft the screw thread surface on said shaft creates a second screw thread in said magnet which tends to drive said magnet away from said actuator.

13. The toner cartridge of claim 12 wherein said rotatable actuator member is a friction roll and said means to rotate is a rotatable pawl.

14. The toner cartridge of claim 12 wherein said means to rotate is a rotatable pawl fixedly mounted on the end of a drive shaft.

15. The toner cartridge of claim 12 wherein said means to secure said magnet against rotational movement comprises a curved shaped housing in securing engagement with said magnet.

16. The toner cartridge of claim 15 wherein said magnet has an extended substantially flat surface in securing nonrotational engagement with said curved shaped housing.

17. The toner cartridge of claim 12 wherein said rotatable actuator member is a gear and said means to rotate is a rotatable pawl.

18. The toner cartridge of claim 17 wherein said rotatable pawl is rotated by a drive system including at least one gear.

* * * * *